US010288276B2

(12) United States Patent
Shoji

(10) Patent No.: US 10,288,276 B2
(45) Date of Patent: May 14, 2019

(54) LED FLOODLIGHT

(71) Applicant: GLANZTECHNOLOGY CO., LTD., Tokyo (JP)

(72) Inventor: Yoshinobu Shoji, Kashiwa (JP)

(73) Assignee: GLANZTECHNOLOGY CO., LTD., Tokyo (JP)

( * ) Notice: Subject to any disclaimer, the term of this patent is extended or adjusted under 35 U.S.C. 154(b) by 149 days.

(21) Appl. No.: 15/519,609

(22) PCT Filed: Oct. 30, 2015

(86) PCT No.: PCT/JP2015/080716
§ 371 (c)(1),
(2) Date: Apr. 17, 2017

(87) PCT Pub. No.: WO2016/068285
PCT Pub. Date: May 6, 2016

(65) Prior Publication Data

US 2017/0241633 A1 Aug. 24, 2017

(30) Foreign Application Priority Data

Oct. 30, 2014 (JP) ..... 2014-221506

(51) Int. Cl.
*F21S 2/00* (2016.01)
*F21V 29/76* (2015.01)
(Continued)

(52) U.S. Cl.
CPC ..... *F21V 29/83* (2015.01); *F21S 2/00* (2013.01); *F21S 8/08* (2013.01); *F21V 3/02* (2013.01);
(Continued)

(58) Field of Classification Search
CPC ..... F21V 29/83; F21V 29/503; F21V 29/76; F21V 3/02; F21V 7/04; F21V 7/041;
(Continued)

(56) References Cited

U.S. PATENT DOCUMENTS 8,740,416 B2 6/2014 Choi
9,508,910 B2 11/2016 Akiyama et al.
(Continued)

FOREIGN PATENT DOCUMENTS

JP H06-236945 A 8/1994
JP 2008-086230 A 4/2008
(Continued)

OTHER PUBLICATIONS

PCT, "International Search Report for International Application No. PCT/JP2015/080716" dated Jan. 26, 2016.

*Primary Examiner* — Bao Q Truong
(74) *Attorney, Agent, or Firm* — Manabu Kanesaka

(57) ABSTRACT

An LED floodlight includes a main unit longitudinally formed by extrusion molding and having in one side an opening of a concave groove, and at least one LED unit attached to an inner bottom wall defining the concave groove in the main unit. The main unit is formed on a back side of the inner bottom wall of the concave groove by the extrusion molding and has at least one ventilating duct and open at upper and lower ends. An area having a large heat capacity is provided between the inner bottom wall to which the LED unit is attached and the ventilating duct. The main unit is configured such that the LED unit is turned on in a posture where a longitudinal direction of the ventilating duct defines a vertical direction thereby transferring heat conducted from the LED unit to an airflow going up through the ventilating duct.

12 Claims, 9 Drawing Sheets

(51) Int. Cl.

| | |
|---|---|
| ***F21V 29/83*** | (2015.01) |
| ***F21V 7/04*** | (2006.01) |
| ***F21V 29/503*** | (2015.01) |
| ***F21S 8/08*** | (2006.01) |
| ***F21V 3/02*** | (2006.01) |
| ***F21V 19/00*** | (2006.01) |
| ***F21V 21/14*** | (2006.01) |
| ***F21V 15/01*** | (2006.01) |
| ***F21V 15/015*** | (2006.01) |
| *F21Y 105/18* | (2016.01) |
| *F21Y 113/13* | (2016.01) |
| *F21Y 115/10* | (2016.01) |
| *F21V 31/00* | (2006.01) |
| *F21W 131/10* | (2006.01) |
| *F21Y 103/10* | (2016.01) |
| *F21V 21/30* | (2006.01) |

(52) U.S. Cl.
CPC ..... *F21V 7/04* (2013.01); *F21V 7/041* (2013.01); *F21V 15/013* (2013.01); *F21V 15/015* (2013.01); *F21V 19/003* (2013.01); *F21V 21/14* (2013.01); *F21V 29/503* (2015.01); *F21V 29/76* (2015.01); *F21V 21/30* (2013.01); *F21V 31/005* (2013.01); *F21W 2131/10* (2013.01); *F21Y 2103/10* (2016.08); *F21Y 2105/18* (2016.08); *F21Y 2113/13* (2016.08); *F21Y 2115/10* (2016.08)

(58) Field of Classification Search
CPC .... F21V 15/013; F21V 15/015; F21V 19/003; F21V 21/14; F21V 21/30; F21V 31/005; F21S 2/00; F21S 8/08; F21Y 2105/18; F21Y 2113/13; F21Y 2103/10; F21Y 2115/10; F21W 2131/10
See application file for complete search history.

(56) References Cited

U.S. PATENT DOCUMENTS

| | | | | |
|---|---|---|---|---|
| 2010/0029268 | A1* | 2/2010 | Myer | F21S 2/00 455/426.1 |
| 2012/0218757 | A1* | 8/2012 | Gill | F21V 15/015 362/235 |
| 2012/0268936 | A1* | 10/2012 | Pickard | F21K 9/90 362/249.02 |
| 2013/0141911 | A1* | 6/2013 | Chen | F21V 29/745 362/249.02 |
| 2013/0229806 | A1 | 9/2013 | Choi | |
| 2013/0258671 | A1* | 10/2013 | Baumann | F21V 29/70 362/293 |
| 2014/0036511 | A1* | 2/2014 | Whitfield | F21V 27/005 362/311.02 |
| 2014/0367710 | A1 | 12/2014 | Akiyama et al. | |
| 2017/0047314 | A1 | 2/2017 | Akiyama et al. | |

FOREIGN PATENT DOCUMENTS

| | | | |
|---|---|---|---|
| JP | 2008-098020 | A | 4/2008 |
| JP | 2008-192787 | A | 8/2008 |
| JP | 2010-027615 | A | 2/2010 |
| JP | 2012-054094 | A | 3/2012 |
| JP | 2012-226959 | A | 11/2012 |
| JP | 2013-243033 | A | 12/2013 |
| JP | 2013-546135 | A | 12/2013 |
| JP | 2014-078687 | A | 5/2014 |
| JP | 2014-175265 | A | 9/2014 |

* cited by examiner

LED FLOODLIGHT

RELATED APPLICATIONS

The present application is National Phase of International Application No. PCT/JP2015/080716 filed Oct. 30, 2015, and claims priority from Japanese Application No. 2014-221506, filed Oct. 30, 2014, the disclosure of which is hereby incorporated by reference herein in its entirety.

FIELD OF THE INVENTION

The present invention relates generally to a large quantity-of-light LED floodlight having multiple LED chips mounted directly on a substrate as light-emitting means, and more specifically to a LED floodlight having a structure capable of efficient dissipation of heat as LEDs are driven on.

BACKGROUND OF THE INVENTION

In view of high luminance (high luminous intensity) and low power consumptions, various lighting packages having LED devices (light-emitting diodes hereinafter simply called LEDs) as light-emitting devices have been introduced commercially. Lighting packages incorporating LEDs ranging from lighting fixtures built up of a mounting vessel (lighting vessel) and one or more LEDs mounted on it and designed with relatively low luminous intensity for indoor lighting to upsized floodlights used for night floodlighting at construction sites and floodlighting used in public installations and sports arenas are or being reduced down to practice in large quantities of light and packages shapes and sizes.

Referring to LED floodlights that must emit out a larger quantity of light as compared with indoor lighting equipments, there are mounting demands for not only lightweight, transportable and relatively small ones but also outdoor floodlights that are less costly and can be temporarily or fixedly mounted in easily installable, outdoor sports arenas. In an LED floodlight package used for such floodlights, the number of LED devices mounted per LED floodlight is greater as compared with LED lighting fixtures or the like used indoors, and for a parallel arrangement of plural such floodlights, it is required to provide a mechanism for efficient radiation of heat generated from them.

Some lighting packages having a radiation fin or other heat sink on an LED-mounted substrate are available; however, it is still difficult to obtain sufficient heat radiation effects. This difficulty may possibly be eliminated by the provision of a forced cooling fan or a liquid circulation cooling structure; however, additional costs will not only be necessary, but there will be a hindrance to wide use as well. Further, when a power circuit is incorporated in it, it is also required to dispose heat generated from it.

Referring to prior arts concerning the LEDs in such LED floodlights, the structure for disposing (dissipating) heats generated from power circuits and LED modules are disclosed typically in Patent Publications 1, 2, 3, 4, 5 and 6.

Patent Publication 1 discloses a LED lighting apparatus in which a LED unit having a plurality of LED devices is mounted on the surface of an aluminum metal unit having a heat radiation fin on the back, and an power supply is fixed on the heat radiation fin thereby thermally isolating off the aluminum metal unit so that the heat of the LED unit is dissipated without being hampered by the heat of the power supply.

Patent Publication 3 discloses that a substantially rectangular cooler apparatus formed of an aluminum member is used, and a mounting substrate having LEDs on its bottom surface is mounted on the bottom surface thereof. The cooler apparatus is provided with an airflow passage communicating from its side surface to its top surface, and air within the airflow passage is warmed by heat generated as the LEDs are held on, exiting out from an upper opening in the form of an ascending current. This airflow sucks in surrounding cold air via a side opening and a similar ascending airflow is created accordingly so that heat generated as the LEDs are held on can be dissipated.

In the lighting apparatus disclosed in Patent Publication 3, a heat radiator is mounted on the back surface of the main unit, and a cooling fan and airflow are attached to the heat radiator so that the heat radiation effect on LEDs by the cooling fan is improved.

Among large quantity-of-light LED floodlights in particular, there is for instance a fish-luring light disclosed in Patent Publication 4.

In this fish-luring light, a thick clad of copper foils is interposed between an insulating flat plate having a number of LEDs mounted on it and a heat sink for efficient transmission of generated heat to the fin and dissipation.

Patent Publication 5 discloses a large quantity-of-light assembly wherein a multiplicity of LEDs are mounted on a substrate, and the LEDs are forcedly cooled by a heat pipe attached to the back side of the substrate in which pipe there is a circulation of a working fluid (methyl alcohol or the like) having infrared ray-emitting powders mixed with it, and Patent Publication 6 discloses a large quantity-of-light LED module of small size in which plural LED dies are mounted on a circuit board via a bear chip process.

PRIOR ARTS

Patent Publications

Patent Publication 1: JP(A) 2008-98020
Patent Publication 2: JP(A) 2012-54094
Patent Publication 3: JP(A) 2012-226959
Patent Publication 4: JP(A) 2008-86230
Patent Publication 5: JP(A) 2013-546135
Patent Publication 6: JP(A) 2014-78687

SUMMARY OF THE INVENTION

Objects of the Invention

The fins that are heat radiations means disclosed in Patent Publication 1 or 2 are designed such that heat radiation takes place by way of heat conduction due to contact with outside air; when they are used alone, there is some limitation on the capability of dissipating heat generated from LEDs. The cooling effect may possibly be brought up by increasing the heat capacity and surface area of fins that absorb heat from LEDs and dissipate it. However, this makes the volume of aluminum or other metal forming the fins so large that the total weight of the floodlight gets excessive. For this reason, when the floodlight apparatus is installed typically as a floodlighting apparatus in a sports ground, it is needed to make a trestle robust, resulting in difficulty in installation work. In addition, material costs become high with considerable limitation on a lowering of installation work costs.

The forced air-cooling package using a heat pipe, as disclosed in Patent Publication 5, consumes large power in itself, and the parts count gets considerable large as well. For that reason, it is difficult to reduce the cost of lighting package itself and the cost of installation for assembling a floodlight package. Note here that the fish-luring light described in Patent Publication 4 is used at sea so that it can sufficiently be cooled by a sea wind alone.

The forced cooling package using a heat pipe, as disclosed in Patent Publication 5, has no choice but to be complicated in structure; both the costs of producing and running a floodlight will go high.

As described above, application of the radiation structure for prior LED lighting packages to large (large quantity-of-light) floodlights without modifications to them is not realistic in consideration of package production costs and the incidental costs necessary for the installation of a floodlight assembly. It is a main object to provide a light-weight LED floodlight that has a relatively simple structure and easy to assemble without recourse to any radiation structure formed of a heavy material and having a complicated structure, and without recourse to any forced cooling means.

Embodiments of the Invention

To accomplish the aforesaid object, the LED flood-light according to the invention is embodied as follows.

It is here to be understood that for an easy understanding of the arrangement or construction according to the invention, the invention will be described with reference to numerals appended to the accompanying drawings. However, it is to be noted that the invention disclosed herein is not limited to exemplary arrangements comprising elements indicated by the reference numerals.

(1) A LED floodlight, comprising:

a main unit 1 that is longitudinally formed by extrusion molding of a metal material and has in one side an opening of a concave groove 1E having a U-shaped lateral section, one or more LED units 6 attached to a central portion, as viewed on said cross-section, of an inner bottom wall 1F defining said concave groove 1E in said main unit 1, and a power source unit 4 that is attached to a portion of other side except for said one side where the opening of said concave groove 1E of said main unit 1, a transparent plate 5 that is attached to said opening of said concave groove 1E to cover a front of said LED unit 6, and an upper lid 1B and a lower lid 1D that close up said longitudinally upper and lower ends of said concave groove 1E in said main unit 1 to isolate said LED unit 6 together with said transparent plate 5 from an environment, wherein said main unit 1 is formed on a back side of said inner bottom wall 1F of said concave groove 1E by said extrusion molding and has one or more ventilating ducts 2 that are parallel with said extrusion molding direction and are open at upper and lower ends, an area 1D having a large heat capacity is provided between said inner bottom wall 1F to which said LED unit 6 is attached and said ventilating duct 2, and said main unit 1 is configured such that said LED unit 6 is turned on in a posture where said longitudinal direction of said ventilating duct 2 defines a vertical direction thereby achieving a chimney effect by which heat conducted from said LED unit 6 is transferred to an airflow going up through said ventilating duct 2.

(2) In the LED floodlight according to (1), said ventilating ducts 2 are provided at a central portion, as viewed on said cross-section, of said inner bottom wall 1F of said main unit 1 and on both sides of said central portion, and said area 1D having a large heat capacity is positioned between the back side of said inner bottom wall 1F of said concave groove 1E and the ventilating duct 2 provided at said central portion.

(3) In the LED floodlight according to (2), an opening area of the ventilating duct 2A at said central portion is different from an opening area of the ventilating ducts 2B on both sides of said central portion.

In the LED floodlight according to (3), the opening area of the ventilating duct 2A at said central portion is smaller than the opening area of the ventilating ducts 2B on both sides of said central portion.

(5) In the LED floodlight according to (3), the opening area of the ventilating duct 2A at said central portion is larger than the opening area of the ventilating ducts 2B on both sides of said central portion.

(6) In the LED floodlight according to (3), the opening area of the ventilating duct 2A at said central portion is equal to the opening area of the ventilating ducts 2B on both sides of said central portion.

(7) In the LED floodlight according to (1), said ventilating ducts 2 are located in a laterally symmetric position with respect to the central portion as viewed on said cross-section of said inner bottom wall 1F of said main unit 1.

(8) In the LED floodlight according to (1), said ventilating duct 2 includes a drift means inside for giving a drift 7 to an airflow going up through said ventilating duct 2.

(9) In the LED floodlight according to (1), said main unit 1 includes, on said other side, a number of radiation fins 1A parallel with said extrusion direction.

(10) in the LED floodlight according to (1), the shape of said cross-section of said ventilating duct 2 is circular, oval, polygonal or amorphous, or in any other combined form.

(11) In the LED floodlight according to (1), said LED unit 6 is built up of a light-emitting portion defined by a chip-on-board type LED module having a multiplicity of LED chips directly mounted on a common circular substrate 6B, a funnel-shaped reflector 6C having a small-diameter portion fixed to an outer circumference of said circular substrate 6B and a large-diameter portion located in opposition to said transparent plate 5, and an insulating base 6E for fixedly mounting said circular substrate over an inner bottom wall 1F defining said concave groove 1E in said main unit 1.

(12) In the LED floodlight according to (1), said. LED floodlight comprises a plurality of said LED units 6, and a color temperature of any one (one or two or more of total number) of said plurality of LED units is different from that of other LED unit.

As a matter of course, the invention is not limited to the aforesaid arrangements or constructions; the invention may have various modifications without departing the scope of the technical idea of the invention.

Advantages of the Invention

As described above, the LED floodlight according to the invention is installed in the area to be lit up (such as work sites and sports fields) while the longitudinal direction of its main unit 1 lies in a vertical or upright direction to the ground or, alternatively, in a somewhat oblique direction. A drive circuit contained in the power source unit 4 is turned on to supply power to the LED unit 6. The LED unit 6 emits out light accordingly, making that area bright.

Understandably, a LED have a luminous efficiency of 100 to 200 lm/W and are better than other light sources in terms of luminous efficiency, yet some power supply turns to heat that is ended up with consumption. That is, as LEDs emit out light, most of power making no contribution to light emission is released as radiant heat to the air, or it is transmitted to the main unit 1 via thermal conduction. The heat transmitted to the main unit 1 makes the temperature of the main unit 1 high. The main unit 1, because of being formed of a bulk of a metal having a large heat capacity (aluminum in the examples given herein), has in itself a fast temperature rise rate and functions as a heat buildup buffer.

The arrangement or construction of the invention as described above ensures that the temperature of air prevailing in the ventilating duct 2 provided in the main unit 1 is increased by the heat transmitted to the main unit 1. The heated air decreases in density and gives rise to buoyancy by which it goes up in the ventilating duct 2, exiting out from its upper end. Incidentally, there is a so-called chimney effect prevailing by which an air having a lower temperature flows in from the lower end: the airflow moves up continuously through the ventilating duct 2 and is discharged. The passage of this airflow causes the heat conducted from the LED unit 6 to be so diffused into the air that a lowering or breakdown of the light emission capability due to overheated LEDs can be prevented.

It is here to be noted that heat generated from the power source circuit built in the power source unit 4 attached to the side wall of the main unit 1 is also transmitted from the power source unit 4 to the main unit 1 by way of conduction through a mounting bolt, and entrained by an airflow passing through the ventilating duct 2.

Referring to the ventilating ducts 2, one provided at the central portion of the main unit 6, as viewed on the cross-section of the inner bottom wall 1F, and two provided on both sides of that central portion, the area 1C having a large heat capacity is positioned between the back side of the inner bottom wall 1F of the concave groove 1E and the ventilating duct 2A provided at the central portion. In other words, the ventilating duct 2A provided at the central portion is spaced away from the back side of the inner bottom wall 1F of the concave groove 1E so that there is an increase in the right back portion of the main unit 1 on which the heat of the LED unit 6 is concentrated with the result that the main unit 1 cannot possibly be overheated.

The size (sectional area), sectional shape and location of the plural ventilating ducts 2 provided through the main unit may be determined in consideration of the number of the LED units 6 mounted, the heat distribution of the substrate on which the LEDs are mounted, the heat transfer pattern for the LED unit 6 and the concave groove 1E, etc.

To promote the chimney effect, the drift means 7 is provided within the ventilating duct 2 to give a drift to the airflow going up through the ventilating duct 2. It is then preferable that a fan-shaped fixed member, a fan-shaped member capable of free rotation, a plate piece having an angle with the longitudinal direction of the ventilating duct 2 or the like is retrofitted to the lower end of the ventilating duct 2 or on the way. This drift means 7 gives rotation or turbulence to the airflow going up through the ventilating duct 2 to increase the amount of contact of the inner wall of the ventilating duct 2 with the airflow, ending up with an increased thermal desorption effect. It is not always necessary to provide a floodlight having less generation of heat with the drift means.

Another part may be provided separately for the drift means 7, and it may be incorporated into the ventilating duct 2 after the formation of the main unit 1. A portion of the drift means may be fitted in and fixed to a groove formed in the inner wall of the ventilating duct 2. In view of cost, it is important to dispense with any fixing means such as a screw as much as possible.

If a number of radiation fins 1A parallel with the extrusion direction are provided on the other side of the main unit 1, there is a natural air cooling effect prevailing that assists the chimney effect of the ventilating duct 2 in cooling thereby achieving generally efficient natural air cooling. Similar radiation fins are also preferably provided to the outer surface of the power source unit 4.

According to the aforesaid embodiment (1), the LED unit 6 built up of a light-emitting portion defined by a chip-on-board type LED module having a multiplicity of LED chips directly mounted on a common circular substrate 6B, a funnel-shaped reflector 6C having a small-diameter portion fixed to an outer circumference of said circular substrate 6B and a large-diameter portion located in opposition to said transparent plate 5, and an insulating base 6E for fixedly mounting said circular substrate over an inner bottom wall 1F defining said concave groove 1E in said main unit 1. It is thus possible to form a uniform floodlighting pattern at the area to be floodlit. The use of a material having a low heat resistance (such as ceramics) for the circular substrate 6B and insulating base 6E enables the heat generated from the LEDs to be rapidly transmitted to the main unit 1, resulting in prevention of deteriorations of or damages to the LEDs due to the generation of heat.

Referring to a LED floodlight comprising a plurality of LED units 6, it is possible to obtain any desired coloring rendering property by making the color temperature and spectral distribution of any one of the LED units different from those of other LED unit or units or regulating the mounting ratio of LEDs capable of generating different colors. Color temperature control may be performed by use of LEDs that generate different colors as well as fluorescent materials or filters, and control of voltages and currents by a drive circuit.

As described above, the main unit 1 forming a main part of the heat radiation structure is formed by extrusion molding of a light-weight metal such as aluminum: assembling work can be simpler as compared with an assembly of plate members and production costs may be cut back on. Because the main unit 1 is formed of a metal bulk material and there is no forced air cooling structure required even for a floodlight package having a large heat capacity and a large quantity of light, power is consumed only for the purpose of turning and holding the LEDs on. It is also possible to provide a LED floodlight that needs minimum maintenance work and provides considerable energy savings.

BRIEF EXPLANATION OF THE INVENTION

FIGS. 1(*a*) and 1(*b*) are (a) a top view and (b) a front view illustrative of Example 1 of the LED floodlight according to the invention.

FIGS. 2(*a*) and 2(*b*) are (a) a right side view and (b) a bottom view illustrative of Example 1 of the LED floodlight according to the invention.

FIG. 3 is a sectional view as taken along A-A line of FIG. 1(*a*) for illustration of the internal structure of the LED floodlight according to the invention.

FIGS. 4(*a*) to 4(*e*) are illustrative of Example 2 according to the invention: FIG. 4(*a*) is a sectional view similar to FIG. 3, and FIGS. 4(*b*) to 4(*e*) are plan views illustrative of various arrangements of the drift means.

Figure 10B:
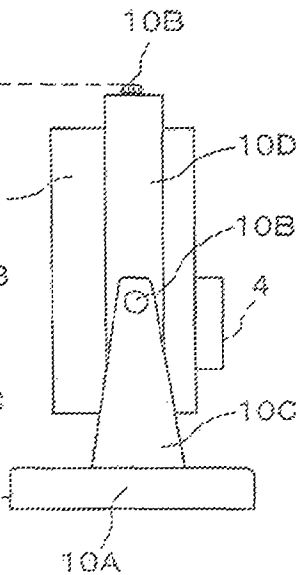
Figure 10A:
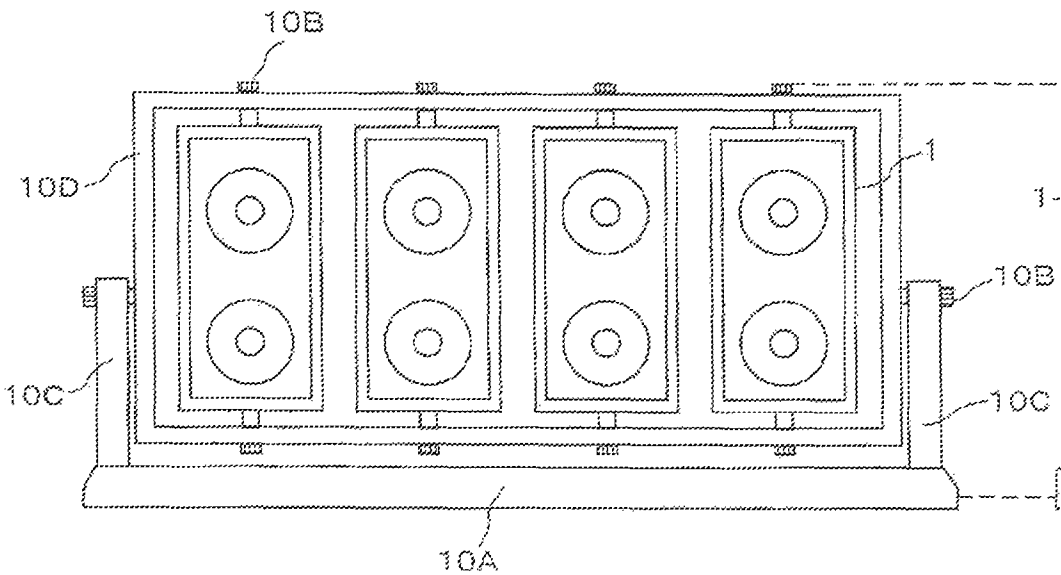

FIGS. 10(*a*) and 10(*b*) illustrate the LED floodlight according to the invention as another commodity product example 8: FIG. 10(*a*) is a front view and FIG. 10(*b*) is a right side view.

Figure 11:
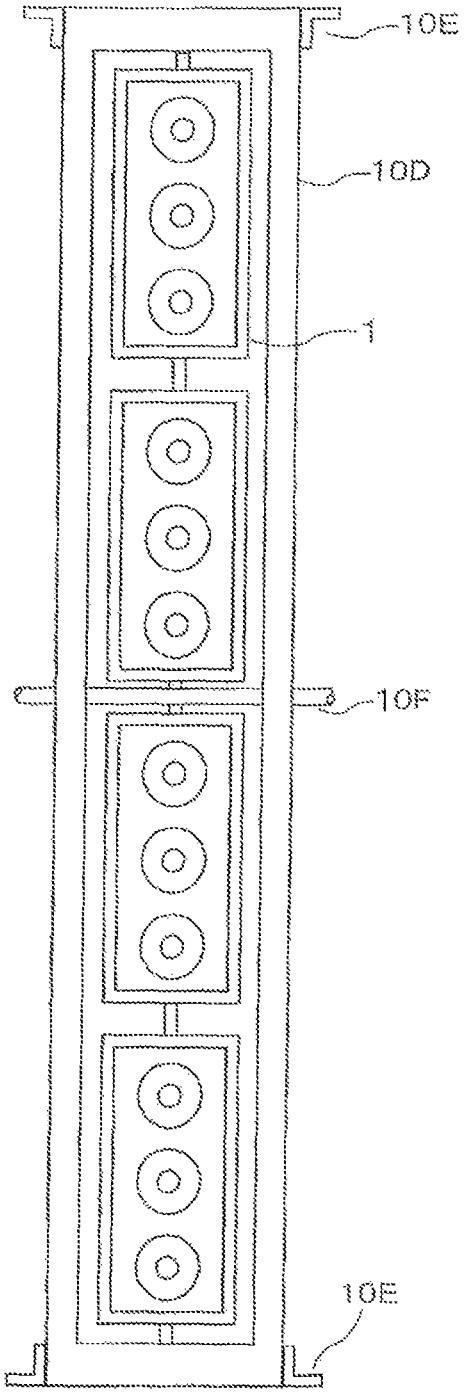

FIG. 11 is a front view illustrative of one exemplary floodlight installation using the LED floodlight according to the invention.

Figure 12:
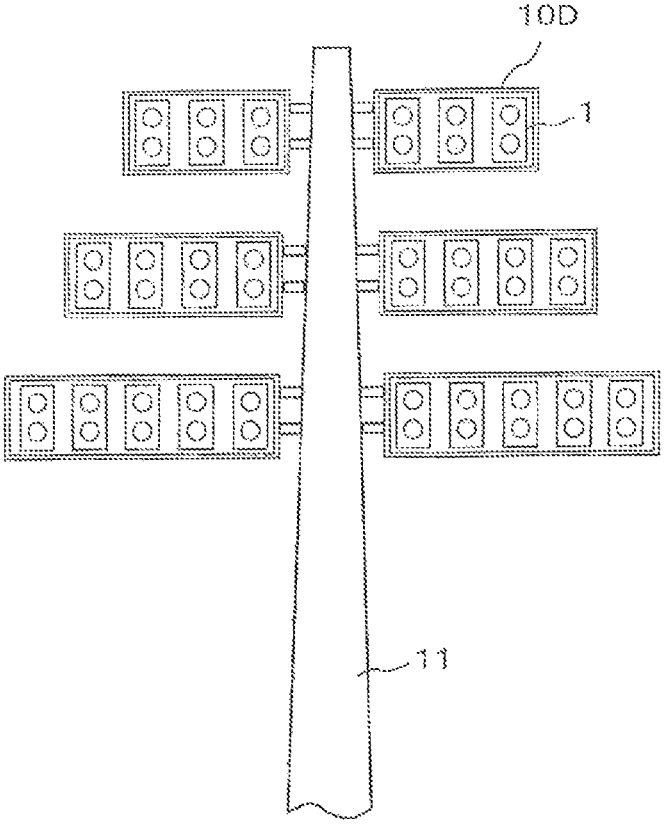

FIG. 12 is a front view illustrative of another exemplary floodlight installation using the LED floodlight according to the invention.

MODES FOR CARRYING OUT THE INVENTION

Some modes for carrying out the invention will now be explained in details with reference to the drawings of examples.

EXAMPLE 1

Figure 1A:
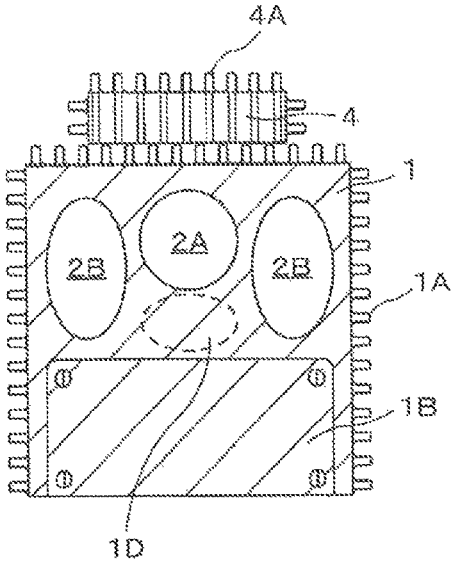
Figure 1B:
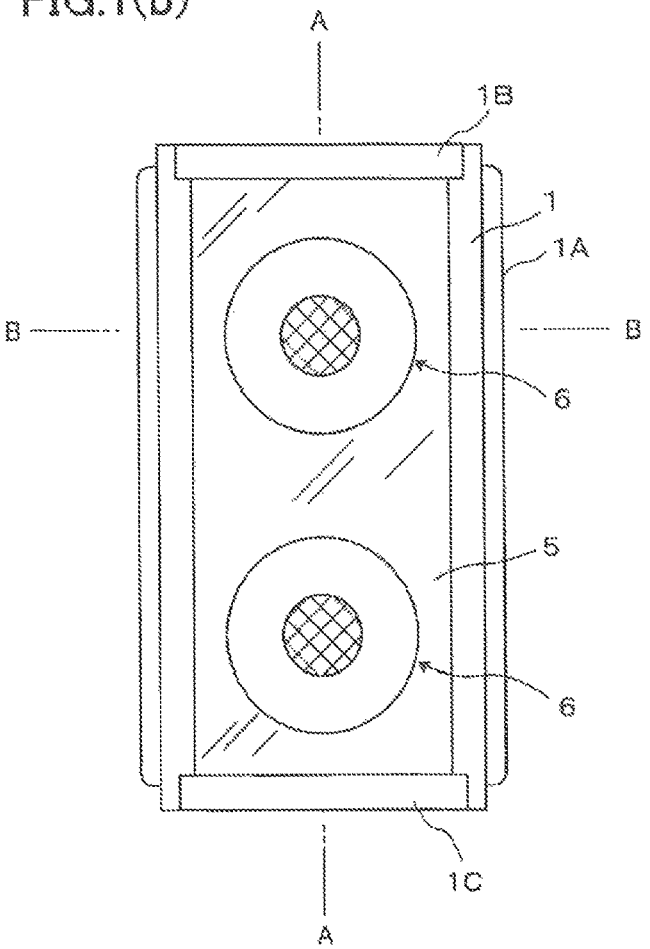
Figure 2A:
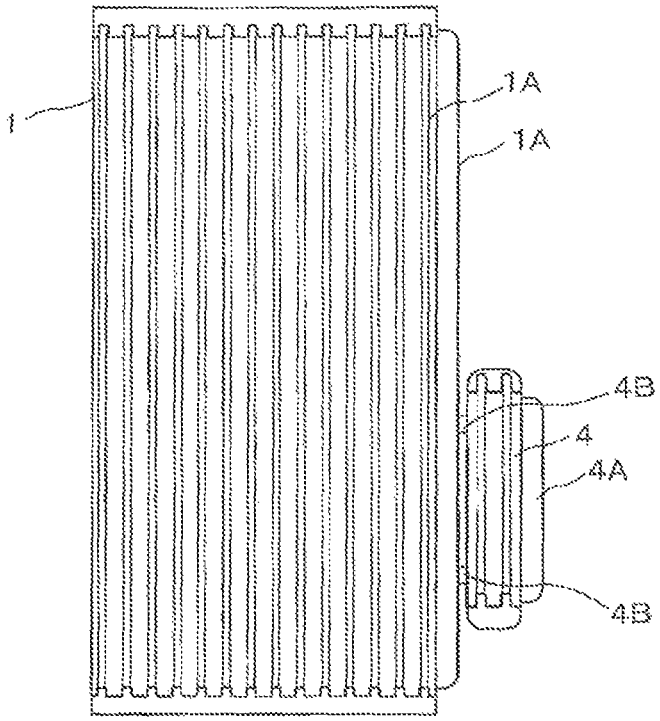
Figure 2B:
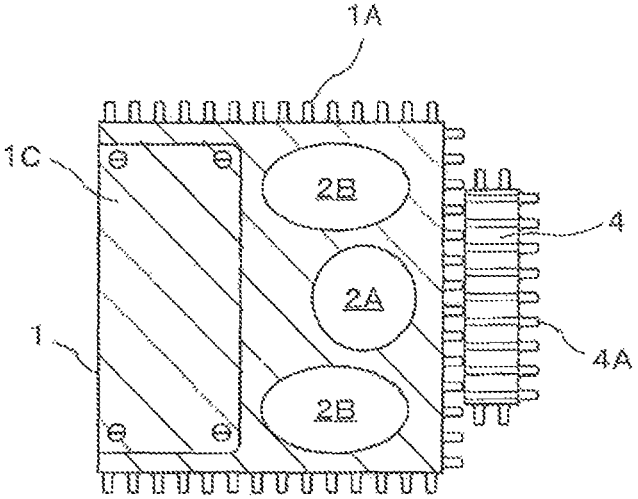
Figure 3:
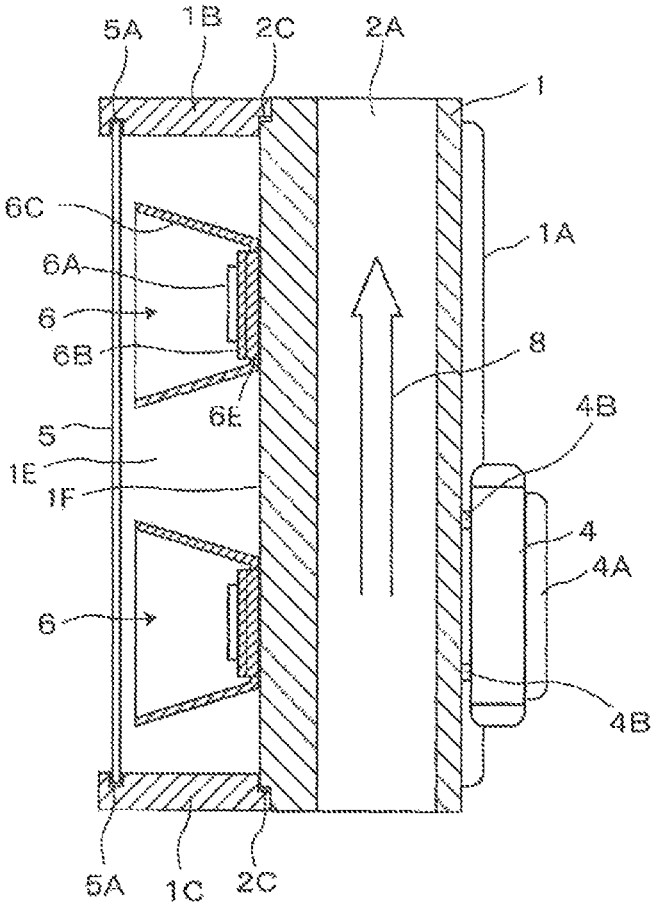

FIG. 1 is illustrative of Example 1 of the LED floodlight according to the invention: FIG. 1(*a*) is a top view and FIG. 1(*b*) is a front view. FIG. 2 is (a) a right side view and (b) a bottom view illustrative of Example 1 of the LED floodlight shown in FIG. 1. FIG. 3 is a sectional view as taken along A-A line in FIG. 1(*a*). As shown in FIGS. 1, 2 and 3, the LED floodlight according to Example 1 of the invention comprises a main unit 1 that is formed by extrusion molding of an aluminum bulk material as a metal material in the longitudinal direction, and has an opening in one side that is defined by a concave groove 1E having a U-shaped section in the lateral direction orthogonal to the (longitudinal) extrusion molding direction). In this example, two LED units 6 are longitudinally mounted on a central portion of the main unit 1 formed as described above, as viewed in lateral section of an inner bottom wall 1F defining the concave groove 1E.

A power source unit 4 is attached to a portion of another side of the main unit 1 except for the aforesaid one side on which the opening of the concave groove 1E is positioned. There is no particular limitation on the position where the power source unit 4 is attached with the proviso that the floodlight is easy to handle and there is no adverse influence on its function. The main unit 1 includes a transparent plate 5 that is attached to the opening of the concave groove 1E to cover up the front portion of the LED unit 5, and an upper 1B and lower lid 1C that isolate the LED unit 6 together with the transparent plate 5 from the outside atmosphere.

In this example, although tempered glass is used for the transparent plate 5 that covers up the front portion of the LED unit 6, it is to be understood that use may be made of a hard resin plate having properties similar to that of tempered glass. The plate of the same aluminum material as is the case with the main unit 1 is used for the upper lid 1B, and the lower lid 1C. Both side edges of the transparent plate 5 are fitted into a sprue provided in the concave groove 1E by way of a rubber bushing 5A and the upper and lower edges are fitted in similar sprues that the upper and lower lids 1B and 1C have by way of a similar rubber bushing 5A to make the interior of the concave groove 1E waterproof and dustproof.

The main unit 1 includes one or more ventilating ducts 2 on the back surface side of the inner bottom wall 1F of the concave groove 1E, which duct or ducts are formed by means of extrusion molding parallel with the extrusion molding direction, and open in the upper and lower ends. Being a sectional view as taken along the longitudinal center line of FIG. 1(*b*), FIG. 3 is illustrative in section of only the ventilating duct 2A. There is an area 1D having a larger heat capacity provided between the internal bottom wall 1F to which the LED unit 6 is attached and the ventilating duct 2. The main unit 1 formed by extrusion molding of the bulk of aluminum material does not only have a large heat capacity in itself, but also has a volume enough to act as a heat buffer in the process of heat transmitted from the LED unit 6 being entrained and dissipated in an airflow passing through the ventilating duct 2.

To achieve this heat buffer more effectively, an aluminum material bulk having a large capacity is provided between the right back surface of the inner bottom wall 1F to which the LED unit 6 is attached and the ventilating duct 2 to define the area 1D having a large heat capacity. Heat generated from the light-emitting portion 6A of the LED unit 6 is transmitted to the main unit 1 by way of the substrate 6B and insulating base 6E. The transmitted heat first enters the area ID having a large heat capacity, and then diffuses throughout the main unit 1. Much heat is held in the area 1D having a large heat capacity. Thus, the heat from the LED unit 6 is transferred to the area 1D having a large heat capacity to prevent any rapid rise in the temperature of the main unit 1, and some heat is also transferred to the whole of the main unit 1 to entrain this heat by the airflow passing through the ventilating duct 2, after which it is dissipated in the air.

The main unit 1 is installed in such a posture that the longitudinal direction (extrusion molding direction) of the ventilating duct 2 is vertical to the ground. In this state, power is supplied to the LED unit 6 to turn it on. The heat transferred from the LED unit 6 to the main unit 1 as it is held on is entrained by an airflow 8 going up through the ventilating duct 2, and the airflow 8 is discharged from the upper end opening into the environment. The ventilating duct 2 functions as a so-called chimney or smokestack by which the heat transmitted to the main unit 1 is entrained from the inner wall of the ventilating duct 2 by way of the airflow 8 passing from the lower end opening to the upper end opening without giving any driving force to it, and then dissipated into the environment.

Referring to the ventilating duct 2 of this example, as shown in FIGS. 1(*a*) and 2(*b*), a center ventilating duct 2A along the longitudinal center line has a circular section, and both ventilating ducts 2B symmetrical with respect to the longitudinal center line (A-A line) have an oval section. To make sure the area 1D having a large heat capacity, the central ventilating duct 2A is offset in the rear of the main unit 1 to surround the area 1D having a large heat capacity with the ventilating duct 2A and ventilating ducts 2B on both its sides. While the central ventilating duct 2A is described as having an opening area smaller than those of ducts 2B formed on both its sides, it is to be understood that the ventilating duct 2A may have an opening area larger than or equal to that of the ventilating ducts 2B. Note here that the cross-sectional surface of the ventilating duct 2 may be circular, oval, polygonal or amorphous, or in any other combined form. The inner wall of the ventilating duct 2 may be provided with a suitable number of fins (inner fins) extending in its longitudinal direction.

In this example, the other side except for the aforesaid one side in which the concave groove 1E in the main unit 1 is positioned is integrally provided with a number of radiation fins 1A parallel with the extrusion molding direction. The provision of radiation fins 1A brings about an increase in the surface area of the main unit 1 in contact with outside air and, hence, improvements in natural air cooling efficiency. It is also preferable that such case cooling fins 4A as shown in FIGS. 1 to 3 are mounted on the outer wall of the power source unit 4 attached to the back surface of the main unit 1 by means of a mounting bolt 4B.

In the example described here, the cooling by the chimney effect of the ventilating duct 2 contributes more to the efficient natural air cooling effect so much so that the heat generated from the LEDs is rapidly discharged into the environment and deteriorations of or damages to the LEDs due to heat buildups can be avoided. The main unit 1 that forms part of the LED floodlight is made up of a bulk material such as aluminum by means of extrusion molding, resulting in a simplification of production processes and achievement of a low-cost, high-performance LED floodlight.

EXAMPLE 2

Figure 4A:
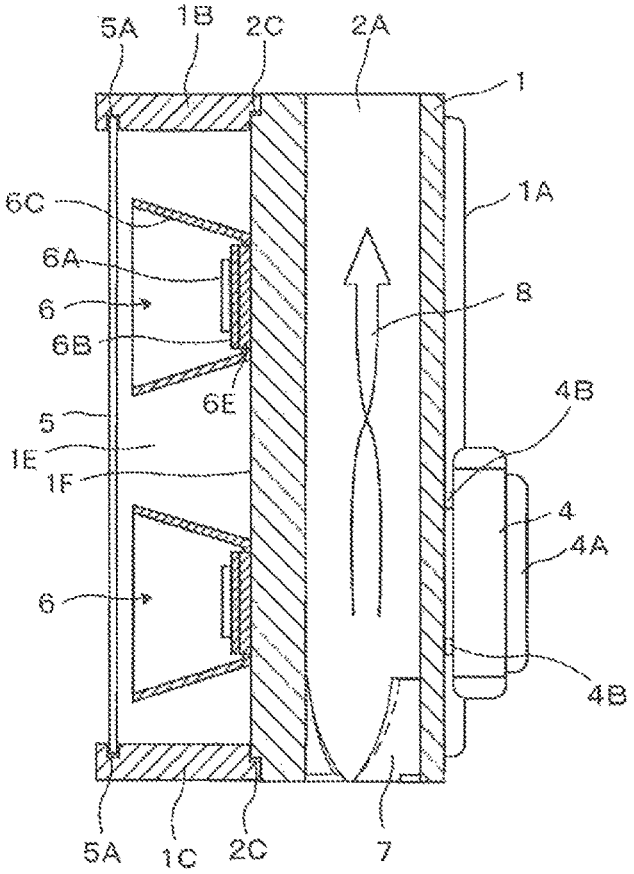
Figures 4B, 4C, 4D, 4E:
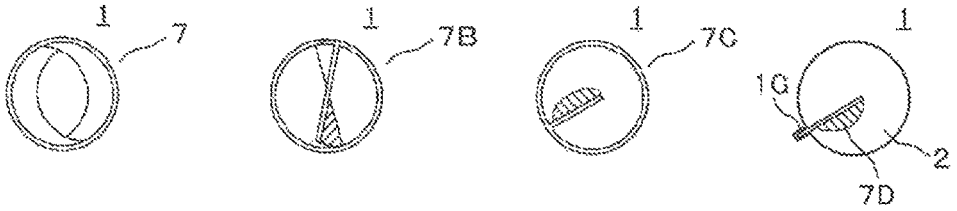

FIG. 4 is illustrative of Example 2 of the LED floodlight according to the invention: FIG. 4(*a*) is a sectional view similar to FIG. 3, and FIGS. 4(*b*) to 4(*e*) are plan views illustrative of various arrangements of the drift means as viewed from the lower or upper end of the ventilating duct. Most of the arrangement and function of the example described here is similar to what is described with reference to FIGS. 1, 2 and 3; reference will be made mainly about elements or components different than those of Example 1, in Example 1, the airflow entering from the lower end opening of the ventilating duct 2 provided in the main unit 1 goes up along the inner wall of the ventilating duct 2 just the way it is, and is discharged from the upper end opening into the external environment.

In Example 2, there is a drift means provided within the ventilating duct 2 to give rotation or turbulence to the airflow 8 going up through the ventilating duct 2. FIGS. 4(*a*) to 4(*e*) are illustrative in schematic of the airflow 8 going up through the ventilating duct 2 to which rotation or turbulence is given. Whether or not the drift means are provided on all or some of the ventilating ducts may be determined by the number and heat-generation distribution of LED units. In FIG. 4, the ventilating duct provided with the drift means is typically represented by the central ventilating duct 2A. While the drift means is provided within the ventilating duct 2 and near its lower end opening in view of effectiveness, it is to be understood that it may be installed in any desired position on the way to the upper end opening.

FIG. 4(*b*) is a plan view of the drift means 7 shown in section in FIG. 4(*a*). A longitudinally spirally tilting fin piece is held by a cylindrical outer ring having an outer diameter somewhat larger than the inner diameter of the ventilating duct 2. This is then fitted into and fixed to the lower end opening of the ventilating duct 2. Referring to the drift means 7B and 7D shown in FIGS. 4(*c*) and 4 (*d*), one plate member having an angle with respect to the longitudinal axis is fixed to an outer ring similar to that of the drift means of FIG. 4(*b*). The drift means of FIG. 4(*e*) is a drift means 7 consisting only of the plate member 7D shown in FIG. 4(*d*). In that drifting means 7, the root or base of the plate member 7D is driven in the longitudinal groove 1G previously formed in the inner wall of the ventilating duct 2.

The drift means is not limited to the aforesaid configuration; it may give a rotation component or turbulence to the airflow moving up through the ventilating duct 2. Alternatively, these drift means may be provided in the form of another component that is then fitted in and fixed to the ventilating duct 2 after the preparation of the main unit 1. Note here that instead of fitting, fixing may be carried out by means of welding, brazing, a screw or the like.

In the example described here, the cooling by the chimney effect of the ventilating duct 2 is augmented by the drift means; more efficient natural air cooling effect is generally achievable so that the heat generated from the LEDs is rapidly discharged into the environment and deteriorations of or damages to the LEDs due to heat buildups can be avoided. Because the main unit 1 that forms part of the LED floodlight is formed by extrusion molding of a bulk material such as aluminum as in Example 1, it is possible to simplify its production process and provide a high-performance LED floodlight at lower costs.

EXAMPLE 3

Figure 5:
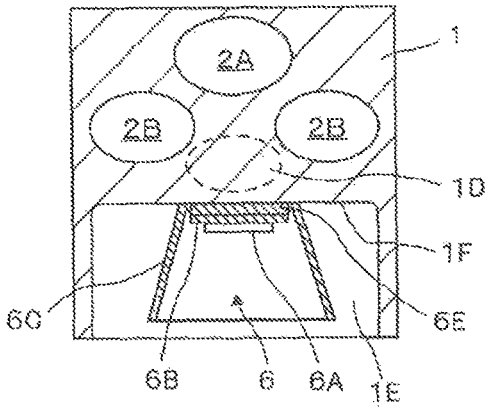
FIG. 5 is a sectional view illustrative of Example 3 of the LED floodlight according to the invention as taken along a cutting plane line corresponding to B-B line in FIG. 1(*b*).

FIG. 5 is a sectional view illustrative of Example 3 of the LED floodlight according to the invention as taken along a cutting plane line corresponding to B-B line in FIG. 1(*b*). In the example described here, three ventilating ducts having an equal sectional area are mounted on the main unit 1, and the area 1D having a large heat capacity is located on the back of the inner bottom wall 1F of the main unit 1 in such a way as to be surrounded with three such ventilating ducts 2A, 2B and 2B. Note here that there may be an inner fin and drift means provided within the ventilating duct 2.

As in the respective examples as described above, heat generated from the light-emitting portion 6A of the LED unit 6 is transmitted to the main unit 1 through the substrate 6B and insulating base 6E. The transmitted heat is first absorbed in the area 1D having a large heat capacity and then diffused throughout the main unit 1 while keeping the main unit 1 against any rapid temperature rise. Much heat is held in the area 1D having a large heat capacity, but that area is cooled by the airflow moving up through the three ventilating ducts 2A, 2B and 2B surrounding it. This action is the same as in the aforesaid respective examples.

In this example too, the generally efficient natural air cooling effect is so achievable that the heat generated from the LEDs can rapidly be released to the environment and deteriorations of or damages to the LEDs due to heat buildups are avoidable. Because the main unit 1 that forms part of the LED floodlight is formed by extrusion molding of a bulk material such as aluminum as in each of the aforesaid examples, it is possible to simplify its production process. It is thus possible to provide a high-performance LED floodlight at lower costs.

EXAMPLE 4

Figure 6:
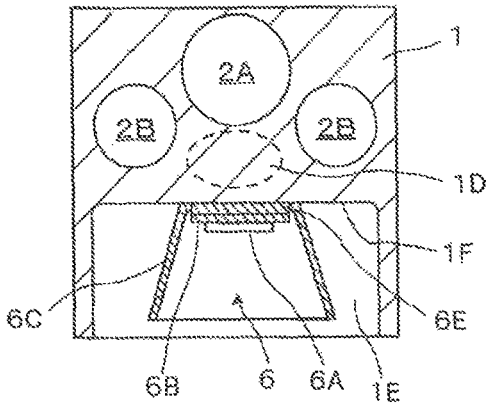
FIG. 6 is a sectional view illustrative of Example 4 of the LED floodlight according to the invention as taken along a cutting plane line corresponding to B-B line in FIG. 1(*b*).

FIG. 6 is a sectional view illustrative of Example 4 of the LED floodlight according to the invention as taken along a cutting plane line corresponding to B-B line in FIG. 1(*b*). This example is identical in construction with Example 3 except that the sectional area of the central ventilating duct 2A is larger than those of ventilating ducts 2B and 2B on both sides of it. The area 1D having a large heat capacity is located on the back of the inner bottom wall 1F of the main unit 6 in such a way as to be surrounded with three ventilating ducts 2A, 2B and 2B. Note here that there may be an inner fin and drift means provided in the ventilating duct 2, as in the aforesaid examples.

In the examples described here too, the heat generated from the light-emitting portion 6A of the LED unit 6 is transmitted to the main unit 1 through the substrate 6B and insulating base 6E, as in each of the aforesaid examples. The transmitted heat is first absorbed in the area 1D having a large heat capacity and then diffused throughout the main unit 1 while keeping the main unit 1 from any rapid temperature rise. Much heat is held in the area 1D having a large heat capacity, but that area is cooled by the airflow moving up through the three ventilating ducts 2A, 2B and 2B surrounding it. This action is the same as in the aforesaid respective examples; however, there is an increasing amount of air passing through the central ventilating duct 2A located in opposition to the LED unit 6 with respect to the area 1D having a large heat capacity and in proximity to the area 1D having a large heat capacity, resulting in efficient radiation of heat from the main unit 1.

Even with the example described here, the generally efficient natural air cooling effect is so achievable that the heat generated from the LEDs can rapidly be released to the environment and deteriorations of or damages to the LEDs due to heat buildups are avoidable. Because the main unit 1 that forms part of the LED floodlight is formed by extrusion molding of a bulk material such as aluminum as in each of the aforesaid examples, it is possible to simplify its production process. It is thus possible to provide a high-performance LED floodlight at low costs.

EXAMPLE 5

Figure 7:
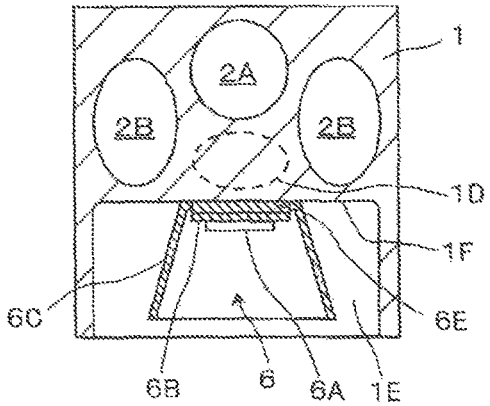
FIG. 7 is a sectional view illustrative of Example 5 of the LED floodlight according to the invention as taken along a cutting plane line corresponding to B-B line in FIG. 1(*b*).

FIG. 7 is a sectional view illustrative of Example 5 of the LED floodlight according to the invention as taken along a cutting plane line corresponding to B-B line in FIG. 1(*b*). The example described here is identical in construction with Example 3 except that the central ventilating duct 2*a* located in the main unit 1 is circular and the ventilating ducts 2B and 2C located on both its sides are oval. The area 1D having a large heat capacity is located on the back of the inner bottom wall 1F of the main unit 6 in such a way as to be surrounded with three such ventilating ducts 2A, 2B and 2B. Note here that there may be an inner fin and drift means provided in the ventilating duct 2, as in the aforesaid examples.

As in each of the aforesaid example, the heat generated from the light-emitting portion 6A of the LED unit 6 is transmitted to the main unit 1 through the substrate 6B and insulating base 6E. The transmitted heat is first absorbed in the area 1D having a large heat capacity and then diffused throughout the main unit 1 while keeping the main unit 1 from any rapid temperature rise. Much heat is held in the area 1D having a large heat capacity, but that area is cooled by the airflow moving up through the three ventilating ducts 2A, 2B and 2B surrounding it. This action is the same as in the aforesaid respective examples.

In this example too, the generally efficient natural air cooling effect is so achievable that the heat generated from the LEDs can rapidly be released to the environment and deteriorations of or damages to the LEDs due to heat buildups are avoidable. Because the main unit 1 that forms part of the LED floodlight is formed by extrusion molding of a bulk material such as aluminum as in each of the aforesaid examples, it is possible to simplify its production process. It is thus possible to provide a high-performance LED floodlight at lower costs.

EXAMPLE 6

Figure 8:
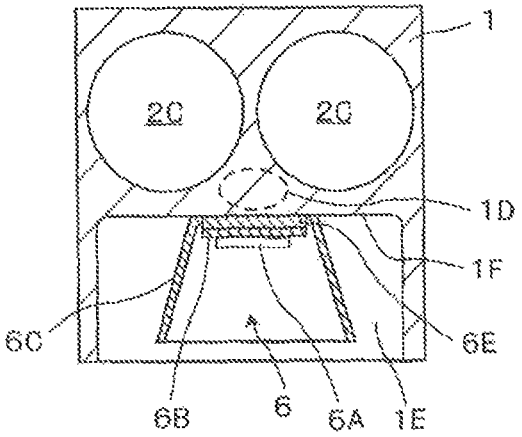
FIG. 8 is a sectional view illustrative of Example 6 of the LED floodlight according to the invention as taken along a cutting plane line corresponding to B-B line in FIG. 1(*b*).

FIG. 8 is a sectional view illustrative of Example 6 of the LED floodlight according to the invention as taken along a cutting plane line corresponding to B-B line in FIG. 1(*b*). In the example described here, two ventilating ducts (2C, 2C) located in the main unit 1 extend in a direction parallel with the bottom wall 1F of the concave groove 1E in the aforesaid section of the main unit 1. The ventilating ducts 2C and 2C have an identical sectional area.

In the example described here, the ventilating ducts 2C and 2C have a large sectional area; it is difficult to increase the volume of the area 1D having a large heat capacity. However, an increasing amount of air flowing through the ventilating ducts 2C and 2C allows the heat transmitted from the LED unit 6 to be relatively rapidly dissipated so that there is no excessive heat buildup in the main unit 1.

In this example too, the generally efficient natural air cooling effect is so achievable that the heat generated from the LEDs can rapidly be released to the environment and deteriorations of or damages to the LEDs due to heat buildups are avoidable. Because the main unit 1 that forms part of the LED floodlight is formed by extrusion molding of a bulk material such as aluminum as in each of the aforesaid examples, it is possible to simplify its production process. It is thus possible to provide a high-performance LED floodlight at lower costs.

EXAMPLE 7

Figure 9:
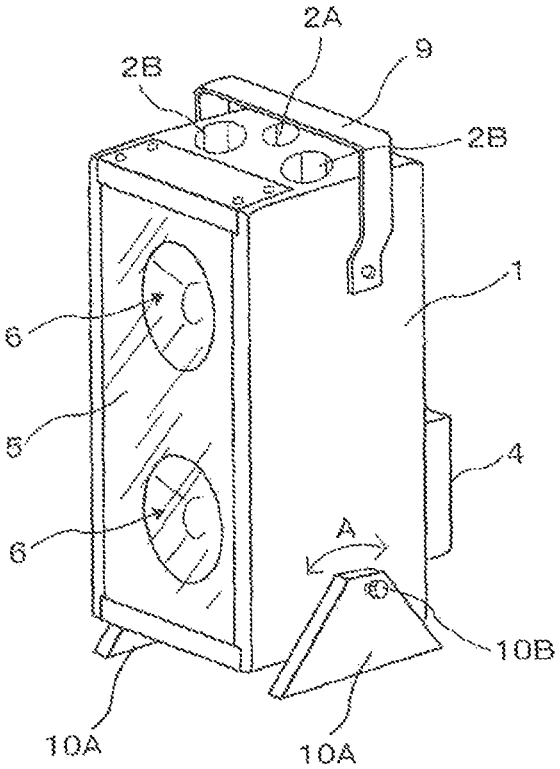
FIG. 9 is a perspective view that illustrates the LED floodlight according to the invention as a commodity product example 7.

FIG. 9 is a perspective view that illustrates the LED floodlight according to the invention as commodity product example 7 wherein the same functional elements as in each of the aforesaid examples are indicated by the same reference numerals. In this LED floodlight, the main unit 1 includes the ventilating ducts of FIG. 1 (2A, 2B and 2B). Two LED units 6 are longitudinally lined up and mounted in the concave groove in the main unit 1, and a tempered glass 5 is provided on the front to isolate the LED unit 6 from outside (external environment). On the back of the main unit 1 there is a power source unit 4 mounted.

Although the aforesaid radiation fins are not provided on the outer side of the LED floodlight shown in FIG. 9, it is to be understood that the main unit may be provided with such radiation fins if required.

This LED floodlight is small and transportable, and has a handle 9 by which a normal worker can carry it around by one hand in interior furnishing for buildings, small-scale road construction sites or the like. The floodlight is provided on both sides of its bottom with a pair of pedestals 10*a* that are attached to the main unit 1 by means of a position-adjustment fixing screw 10B. The pedestals can discretely be adjusted in terms of both position and posture so that they can be placed and fixed on a floor surface having projections and depressions, a misaligned ground or the like in a stable manner. Note here that the pedestals are not limited to the shown ones; they may take on various forms depending on purposes.

The LED floodlight shown in FIG. 9 uses two LED units whose color temperature can be varied to set any desired color rendering property. For instance, 59000K may be given to one and 4000K to the other to obtain a relatively soft daylight color.

EXAMPLE 8

FIG. 10 is illustrative in perspective of the LED floodlight according to the invention as another commodity product example 8. The same functional elements as in each of the aforesaid examples are indicated by the same reference numerals.

This LED floodlight is well fit for night floodlighting in relatively large space. An assembly of four, laterally lined-up LED floodlights of Example 1 is attached to a support frame 10D. This support frame 10D is attached by a position-adjustment fixing screw 10B to two upright posts 10C fixed to the pedestal 10A.

The respective LED floodlights (indicated by the main units 1 may discretely be adjusted by the longitudinal or vertical position-adjustment fixing screw 10B in terms of its horizontal (lateral) orientation, and the angles of elevation and inclination of the two support posts 10D are adjustable by the position-adjustment fixing screw 10B for the two support posts 10C. Note here that the support frame, pedestal and upright post are not limited to those shown; they may be in various configurations depending upon what purpose they are used for, where they are used, etc.

The LED floodlight shown in FIG. 10 may also have any desired rendering property by optionally varying the color temperatures of its four LED units.

EXAMPLE 9

FIG. 11 is a front view illustrative of one exemplary floodlight installation using the LED floodlight according to the invention. The same functional elements as in the aforesaid examples are indicated by the same reference numerals. This LED floodlight is well fit for night floodlighting, etc. in wider space where light from the floodlight is spread in the longitudinal direction. Here, four LED floodlights of Example 1 are longitudinally lined up and attached to the support frame 10D. This support frame 10D is provided with a bracket 10E and a shaft 10F so that it is fixed directly on the inner wall of a gymnasium as an example. Using this LED floodlight as a unit, a plurality of units may be installed depending on the extent to be floodlit.

As in Example 8, the bracket may be located such that the respective LED floodlights (indicated by the main units 1) are rotatable about the longitudinal and lateral axes. In the LED floodlight of FIG. 1 too, any desired color rendering property may be obtained by optionally varying the color temperatures of its four LED units. Note here that the invention is not limited to an assembly of four, longitudinally line-up LED units as shown in FIG. 11; more LED floodlights may be located in the longitudinal or lateral direction.

EXAMPLE 10

FIG. 12 is a front view illustrative of another exemplary floodlight installation using the LED floodlight according to the invention. The same functional elements as in the aforesaid examples are indicated by the same reference numerals. This LED floodlight installation may be provided for the purpose of floodlighting extremely large areas such as sports grounds, ball parks, speedboat courses and bicycle race courses. In the example described, several sets of LED floodlights (indicated by main units 1) according to the invention that are attached to the support frame 10D are attached to a pole 11 of an existing floodlighting installation. As a matter of course, they may be attached to a new pole.

As shown in FIG. 12, the number of LED floodlights attached to the support frames 10D increases in order from top to bottom, but this is just an example; the number of LED floodlights may optionally be adjusted depending on floodlighting conditions in a sports ground or the like. The LED floodlight installation may also have any desired rendering property by optionally varying the color temperatures of plural LED units.

It is here to be noted that there may be multiple LED floodlights provided, among which some may be selectively turned on.

Various examples of the invention have been described. While the cross-section of the ventilating duct provided in the main unit has been described as being circular and/or oval in the examples of the invention, it is to be understood that triangular or polygonal, and/or amorphous cross-sections are also encompassed in the scope of the invention.

Repeatedly, the LED unit according to the invention is built up of a light-emitting portion defined by a chip-on-board type LED module having a multiplicity of LED chips are directly mounted on a common circular substrate, a funnel-shaped reflector having a small-diameter portion fixed to the outer circumference of the circular substrate and a large-diameter portion located in opposition to the transparent plate (tempered glass), and an insulating base for fixedly mounting the circular substrate over the inner bottom wall defining the concave groove in the main unit.

EXPLANATION OF THE REFERENCE NUMERALS

1: Main unit
1A: Radiation fin
1B: Upper lid
1C: Lower lid
1D: Area having a large heat capacity
1E: Concave groove
1F: Inner bottom wall
1G: Groove
2: Ventilating duct
2A: Central ventilating duct
2B: Side ventilating duct
2C: Packing
4: Power source unit
4A: Case cooling fin
4B: Mounting bolt
5: Transparent plate
5A: Rubber bushing
6: LED unit
6A: Light-emitting portion
6B: Circular substrate
6C: Reflector
6E: Insulating base
7: Drift means
8: Airflow
9: Handle
10, 10A: Pedestal
10B: Position-adjustment fixing screw
10C: Post
10D: Support frame
10E: Bracket
10F: Shaft
11: Pole

What is claimed is:

1. An LED floodlight, comprising:

a main unit extending in a longitudinal direction and formed by a metal material, said main unit including an opening of a concave groove on one side of said main unit, having a U-shaped lateral section, an inner bottom wall defining said concave groove, and a ventilating duct formed on a back side of said inner bottom wall opposite to said concave groove and extending in said longitudinal direction of said main unit, said ventilating duct being opened at upper and lower ends and including a fin fixed inside the ventilating duct for providing a rotation to an airflow passing through said ventilating duct, an LED unit attached to a central portion, as viewed in cross-section of said inner bottom wall defining said concave groove in said main unit, a power source unit attached to a portion of another side of said main unit except for said one side with the opening of said concave groove, a transparent plate attached to said opening of said concave groove to cover a front of said LED unit, an upper lid and a lower lid that close upper and lower ends of said concave groove in said longitudinal direction of said main unit, respectively, to isolate said LED unit together with said transparent plate from an environment, and an area having a heat capacity and provided between said inner bottom wall to which said LED unit is attached and said ventilating duct, wherein said main unit is configured such that said LED unit has a posture where said longitudinal direction of said ventilating duct is aligned in a vertical direction to have a chimney effect by which heat conducted from said LED unit is transferred to the airflow going up through said ventilating duct, and the fin provides the rotation to increase an amount of contact of said ventilating duct with the airflow.

2. The LED floodlight according to claim 1, further comprising two other ducts arranged such that said ventilating duct is provided at a central portion, as viewed in said cross-section, of said inner bottom wall of said main unit, and the two other ducts are arranged on two sides of said vending duct, and said area having the heat capacity is positioned between the back side of said inner bottom wall of said concave groove and the ventilating duct provided at said central portion.

3. The LED floodlight according to claim 2, wherein an opening area of the ventilating duct in said central portion is different from an opening area of the two other ventilating ducts on both sides of said central portion.

4. The LED floodlight according to claim 3, wherein the opening area of the ventilating duct at said central portion is smaller than the opening area of the two other ventilating ducts on both sides of said central portion.

5. The LED floodlight according to claim 3, wherein the opening area of the ventilating duct at said central portion is larger than the opening area of the two other ventilating ducts on both sides of said central portion.

6. The LED floodlight according to claim 3, wherein the opening area of the ventilating duct at said central portion is equal to the opening area of the two other ventilating ducts on both sides of said central portion.

7. The LED floodlight according to claim 1, wherein said two other ventilating ducts are located in a laterally symmetric position with respect to the the vending duct as viewed in said cross-section of said inner bottom wall of said main unit.

8. The LED floodlight according to claim 1, wherein said main unit includes, on said another side, a number of radiation fins extending in parallel with said longitudinal direction.

9. The LED floodlight according to claim 1, wherein a shape of said cross-section of said ventilating duct is circular, oval, polygonal or amorphous, or in a combination thereof.

10. The LED floodlight according to claim 1, wherein said LED unit is built up of a light-emitting portion defined by a chip-on-board type LED module having a multiplicity of LED chips directly mounted on a common circular substrate, a funnel-shaped reflector having a small-diameter portion fixed to an outer circumference of said circular substrate and a large-diameter portion located in opposition to said transparent plate, and an insulating base for fixedly mounting said circular substrate over an inner bottom wall defining said concave groove in said main unit.

11. The LED floodlight according to claim 1, wherein said LED unit comprises a plurality of other LED units, and a color temperature of any one of said plurality of LED units is different from that of the other.

12. The LED floodlight according to claim 1, wherein the fin extends diagonally across the ventilating duct in a direction crossing the longitudinal direction.

* * * * *